US005485659A

United States Patent [19]

Kashikie et al.

[11] Patent Number: 5,485,659

[45] Date of Patent: Jan. 23, 1996

[54] BUCKLE FOR WATCH BANDS

[75] Inventors: Junsuke Kashikie; Hideo Taguchi, both of Tanashi, Japan

[73] Assignee: Citizen Watch Co., Ltd., Tokyo, Japan

[21] Appl. No.: 338,513

[22] PCT Filed: Mar. 25, 1994

[86] PCT No.: PCT/JP94/00481

§ 371 Date: Nov. 25, 1994

§ 102(e) Date: Nov. 25, 1994

[87] PCT Pub. No.: WO94/22340

PCT Pub. Date: Oct. 13, 1994

[30] Foreign Application Priority Data

Mar. 26, 1993 [JP] Japan ..... 5-019744 U
Mar. 15, 1994 [JP] Japan ..... 6-043543

[51] Int. Cl.[6] ..... A44C 5/00

[52] U.S. Cl. ..... 24/71 J; 24/68 J; 24/265 WS

[58] Field of Search ..... 24/71 J, 70 J, 24/69 J, 68 J, 265 WS

[56] References Cited

U.S. PATENT DOCUMENTS 4,675,955 6/1987 Nakamura ..... 24/68 J
5,191,685 3/1993 Aoki et al. ..... 24/265 WS
5,313,691 5/1994 Hashimoto .

FOREIGN PATENT DOCUMENTS 51-76469 6/1976 Japan .
5970514 5/1984 Japan .
59-81411 6/1984 Japan .
2121806 10/1990 Japan .
3127519 12/1991 Japan .
665536 5/1988 Sweden .
WO88/02225 4/1988 WIPO .

*Primary Examiner*—Victor N. Sakran
*Attorney, Agent, or Firm*—Dennison, Meserole, Pollack & Scheiner

[57] ABSTRACT

A buckle for watch bands has a cover (1), a guide housing (15) secured to an inside of the cover, the guide housing having a pair of push plates (19) each of which has an engaging projection (21) and springs. A middle plate (16) and a tongue (6) are rotatably connected to an end of the cover, and a bottom plate (18) having a band connecting portion and an engaging lug (23) is rotatably connected to the middle plate. A band is connected to the band connecting portion of the bottom plate. Another band having adjusting holes is inserted into a space between the cover (1) and the housing (15) and the tongue (6) is inserted into the adjusting hole so as to adjust the length of the band.

5 Claims, 7 Drawing Sheets

BUCKLE FOR WATCH BANDS

TECHNICAL FIELD

The present invention relates to a buckle for watch bands.

BACKGROUND ART

FIG. 10 shows a perspective view of a conventional buckle having an ordinary structure.

A buckle connected to one of the watch bands 10 comprises a frame 20 and a tongue 40. An end of the other band 30 is inserted into the frame 20 from the underside of the buckle. The band 30 is pulled in the reverse direction at the frame 20. The tongue 40 is engaged with one of adjusting holes 30*a* of the band 30 at a desired length. Thus, the length of the band is easily adjustable and the band is worn in good feeling.

However, in such a conventional buckle, the band must be attentively inserted in the frame of the buckle from the underside thereof. Otherwise, the buckle may disengage, and the watch may drop. Furthermore, the frame and the tongue rub the surface of the band, causing it to hurt and the life of the band to shorten.

Japanese Utility Model Application Laid-open No. 3-127519 discloses a buckle which may eliminate the above mentioned defects. As shown in FIGS. 11 and 12, the buckle comprises a rectangular frame 31 in which a first band 42 having a plurality of engaging holes 44 is inserted, a middle plate 46 rotatably connected to an end of the frame, and a bottom plate 48 rotatably connected to the middle plate and a second band 50. The frame 31 has an inner space approximately equal to the thickness of the first band 42. An end of the middle plate 46 is connected to a connecting portion 34 secured to the underside of the frame 31 with a pin 32. A tongue 36 is fixed to the pin 32 to be rotatably supported by the connecting portion 34, and engaged with one of the engaging holes 44 of the first band 42. The middle plate 46 further has an engaging recess 46*a* to be engaged with an engaging portion 56 provided on the bottom plate 48. The second band 50 is connected to an end of the bottom plate 48 through a connecting link 52.

In order to use the buckle, the first band 42 is inserted into the frame 31 and the tongue 36 is rotated and inserted into one of the holes 44 of the band at a preferable length so that the band 42 is secured in the frame 31. The frame 31 is pressed against the bottom plate 48 so that the recess 46*a* of the middle plate 46 engages with the engaging portion 56 of the bottom plate 48. If a tension is exerted on the band 42 for expanding the band, the tongue 36 is abutted on a side 46*b* of the middle plate 46, thereby preventing the band from expanding. In order to disengage the buckle, the frame 31 is picked up and pulled up from the bottom plate 48. Thus, the middle plate is disengaged from the bottom plate 48, so that the ring formed by the bands 42 and 53 is expanded. Therefore, the watch can be removed from the wrist.

In the buckle, since the effective length of the band is adjusted once to a desired length, the band is not rubbed by the tongue. Thus, the band is not hurt. However, it is not easy to pick up the frame 31 from the bottom plate with fingers because of the thin frame.

An object of the present invention is to provide a buckle for watch bands in which the length of the band can be easily adjustable.

Another object of the present invention is to provide a buckle for watch bands which is easily operable.

DISCLOSURE OF THE INVENTION

According to the present invention, there is provided a buckle for watch bands having a first band member having a plurality of adjusting holes and a second band member, the buckle including a cover having opposite side plates, each of which has an opening, a middle plate rotatably connected to an end of the cover at a longitudinal first end thereof, and a bottom plate rotatably connected to a second end of the middle plate at one of longitudinal ends thereof, the buckle comprising a guide housing disposed in an inside of the cover, a space formed between an upper plate of the guide housing and an inside wall of the cover in which the first band member is inserted and supported, a pair of push plates slidably mounted in the guide housing so as to be slid in the lateral direction with respect to the longitudinal direction of the bands, a spring provided between the push plates for outwardly urging the push plates respectively, stopping means for stopping each of the push plates at a position where an outer end portion of the push plate is projected from the opening of the side plate of the cover so as to be operated by a finger of a wearer, each push plate having an engaging projection and a slant formed on the underside of the engaging projection, a tongue rotatably mounted on the first end of the middle plate to be engaged with the adjusting hole of the first band member, and at least one engaging lug formed on the bottom plate to be projected to the push plates, the engaging lug being arranged such that a part of the lug is engaged with the slant of the push plate so as to inwardly move the push plate due to the inclination of the slant when the bottom plate is pivoted toward the cover, and that the engaging lug engages with the engaging projection when passing the slant.

When the cover is pressed against the bottom plate, the engaging projection engaged with the slants to urge the push plates inwardly. The engaging projection passes the slants to be engaged with the engaging projections of the push plates so that the buckle is coupled. By pushing the push plates at the same time, the engaging portion is disengaged from the engaging projection to disengage the buckle.

BEST MODE FOR EMBODYING THE INVENTION

Figure 1:
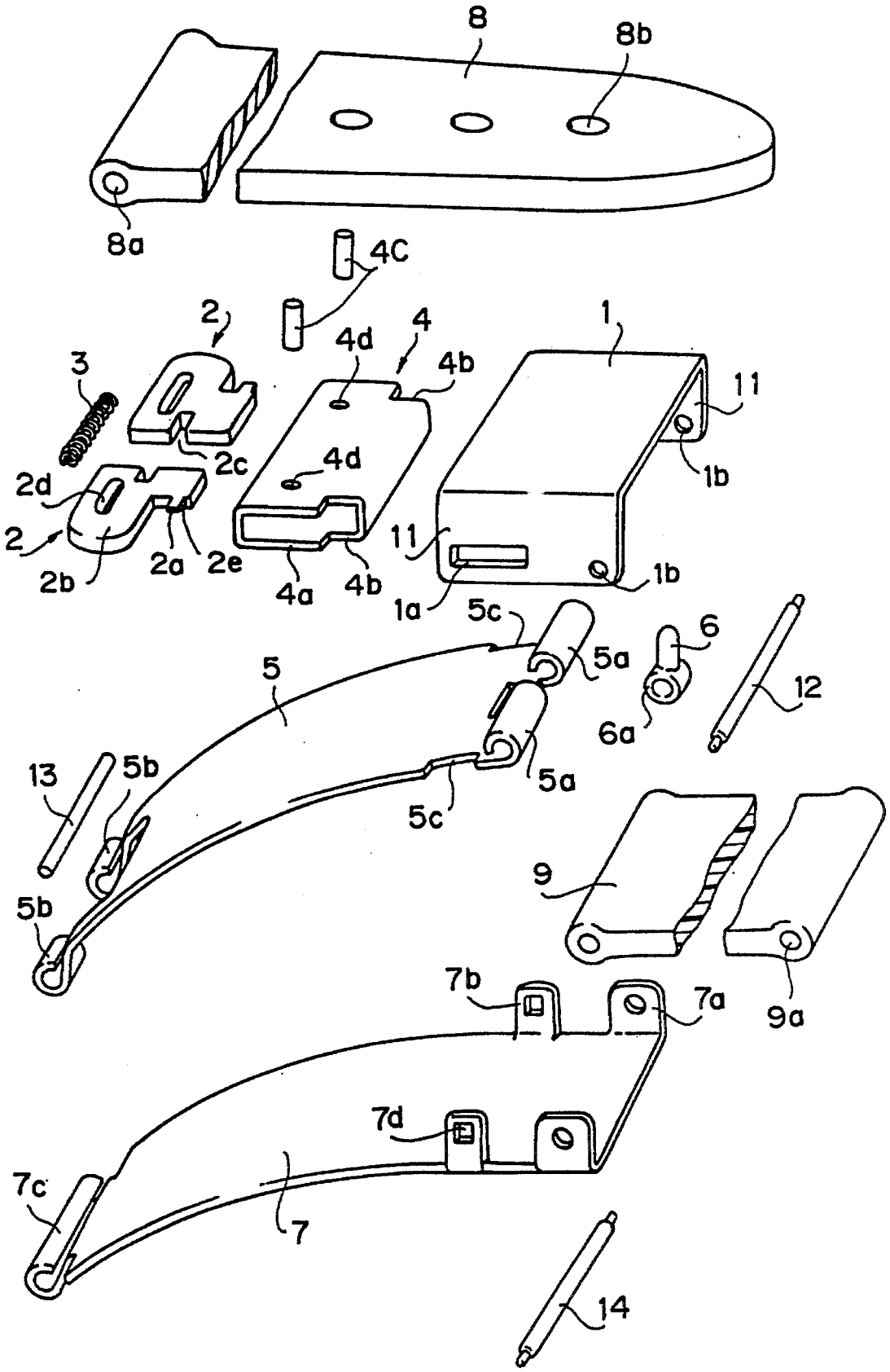
FIG. 1 is an exploded perspective view showing a buckle for watch bands according to the present invention.

An embodiment of the present invention will be described hereinafter in detail with reference to the accompanying drawings. FIG. 1 is an exploded perspective view showing a buckle for watch bands according to the present invention, FIG. 2 is a sectional plan view of the buckle, and FIG. 3 is a sectional view of the buckle taken along a line III—III of FIG. 2.

Figure 2:
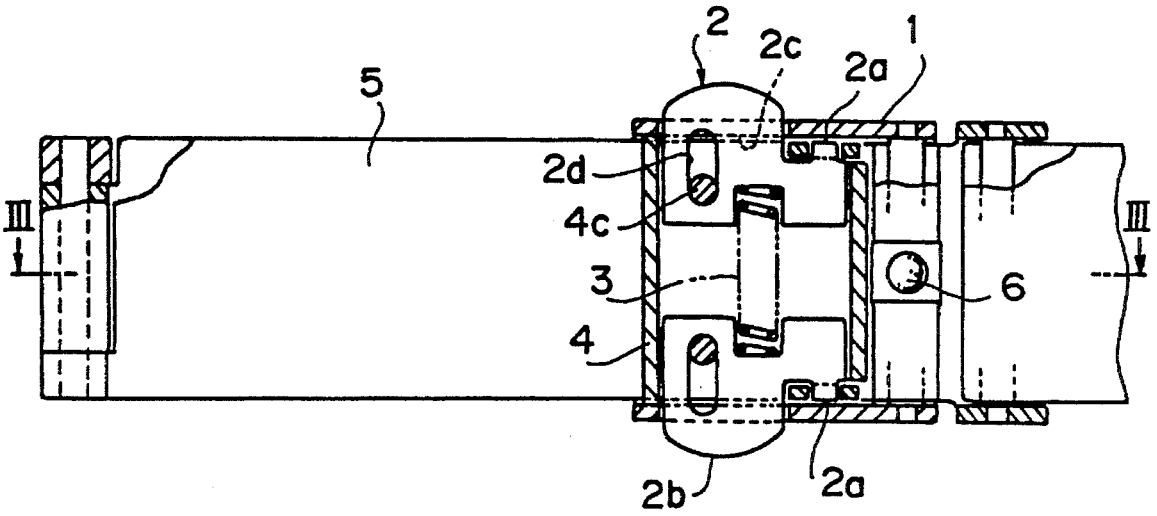
FIG. 2 is a sectional plan view of the buckle.
Figure 3:
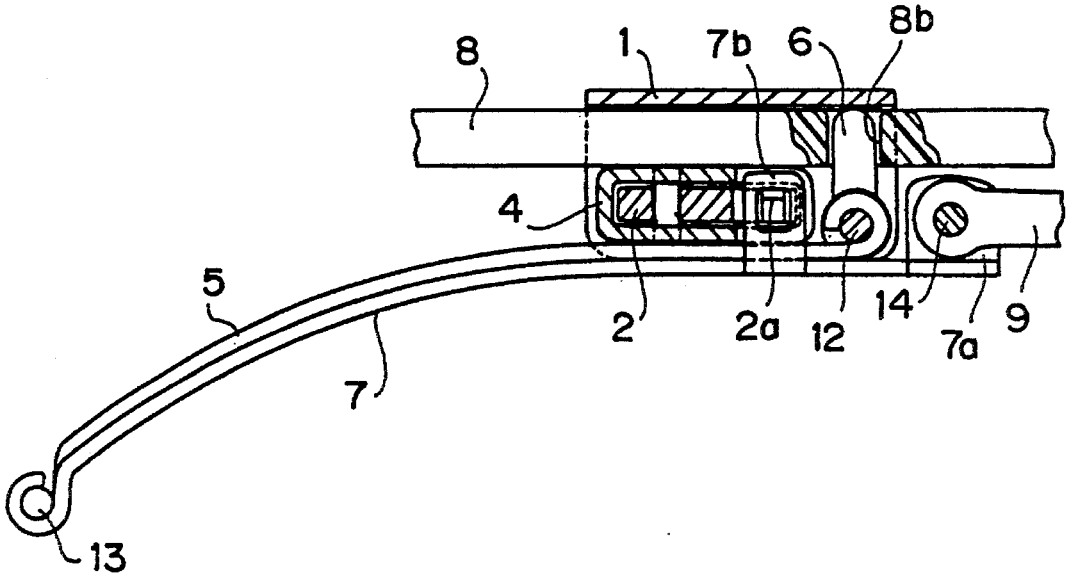
FIG. 3 is a sectional side view of the buckle taken along a line III—III of FIG. 2.
Figure 4:
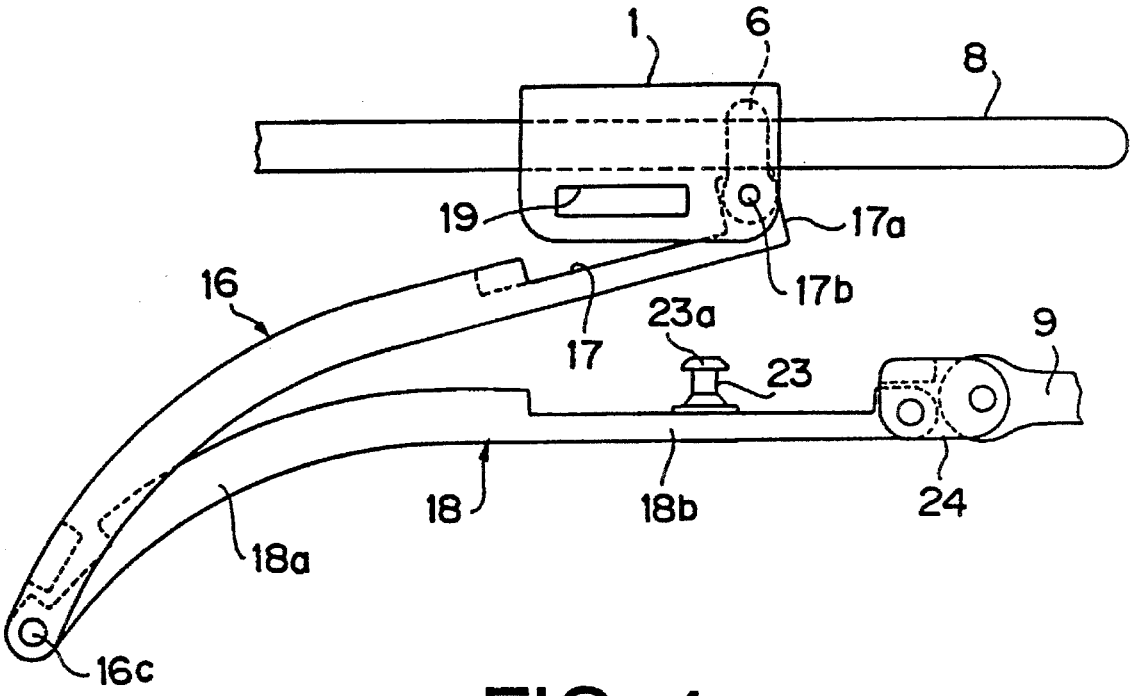
FIG. 4 is a side view showing a buckle of a second embodiment in an opening state.
Figure 5:
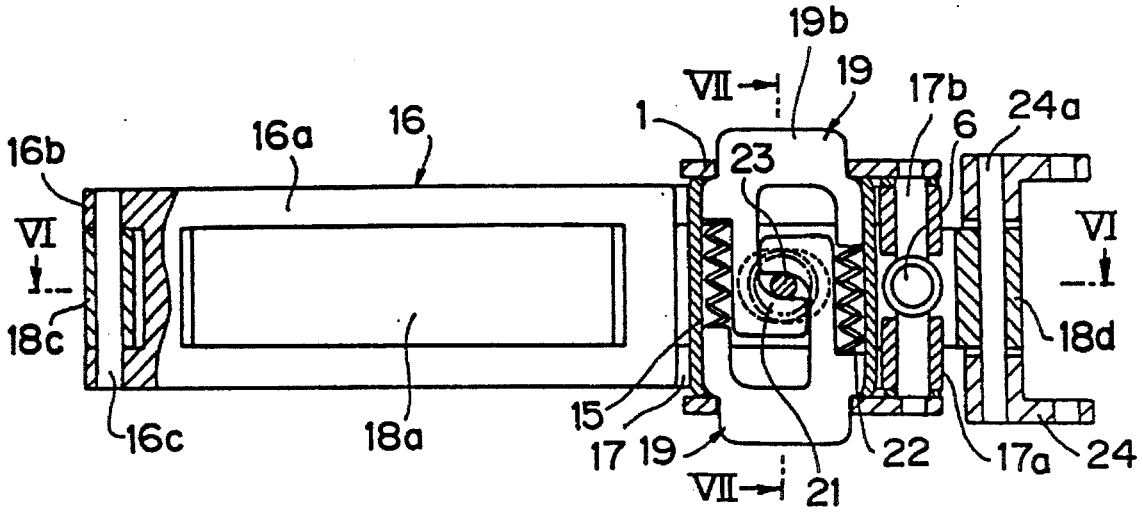
FIG. 5 is a sectional plan view of the buckle of FIG. 4.

Referring to FIGS. 1 to 3, a triple-fold type buckle of the present invention comprises a cover 1 connected to a first watch band 8 having a plurality of adjusting holes 8*b*, a bottom plate 7 connected to a second watch band 9, and a middle plate 5 connected to the cover 1 and the bottom plate 7.

The cover 1 comprises a pair of side plates 11 integrated therewith. Each side plate 11 has a rectangular opening 1*a* formed at an end portion thereof, and a pin hole 1*b* formed at another end portion. The side plate 11 has a sufficient height to form a space for supporting the first band 8 in the cover.

A hollow guide housing 4 is disposed inside the cover 1 corresponding to the opening 1*a* of the side plates 11. The guide housing 4 has a pair of openings 4*a* at opposite ends thereof, and a pair of notches 4*b* each of which is formed at one of the corners thereof by cutting the upper and lower plates of the housing.

A pair of push plates 2 are slidably mounted in the space of the housing 4 so as to be moved in the lateral direction of the band. The push plates 2 are the same in configuration and are symmetrically disposed in the housing 4. Each push plate 2 comprises a manipulating lug 2*b* projected from the opening 1*a* of the cover 1 through the opening 4*a*, an engaging projection 2*a* outwardly projected, and a notch 2*c* formed to be engaged with a return spring 3 so as to urge the push plate 2 outwardly. The engaging projection 2*a* has a slant 2*e* formed on the underside thereof.

The middle plate 5 is formed to be curved so as to fit a wrist of a wearer and comprises a pair of rounded portions 5*a* and 5*b* provided at both ends thereof, respectively. The rounded portions 5*a* are engaged with a spring-loaded pin 12 or a pin, and the rounded portions 5*b* are engaged with a pin 13 or a spring-loaded pin. Between the rounded portions 5*a*, a tongue 6 is inserted. The tongue 6 has a cylindrical base 6*a* rotatably mounted on the spring-loaded pin 12. The tongue 6 is rotatable in the clockwise direction at a position shown in FIG. 3 and prevented from rotating in the counterclockwise direction by a stopper (not shown). Consequently, as shown in FIG. 3, when the tongue 6 is engaged with the adjusting hole 8*b* of the first band 8, the first band 8 can not be moved in the left, preventing the band from loosening. The middle plate 5 is further provided with a pair of notches 5*c* formed on both sides corresponding to the notches 4*b* of the housing 4.

The bottom plate 7 is curved along the middle plate 5. The bottom plate 7 has a pair of connecting lugs 7*a* each having a hole provided at one of ends and formed by bending each side toward the cover for connecting a second watch band 9 and a rounded portion 7*c* provided at the other end. A pair of engaging lugs 7*b* each having an engaging hole 7*d* are formed on both sides of the bottom plate corresponding to the notches 5*c* of the middle plate 5. The engaging hole 7*d* is engaged with the engaging projection 2*a* of the push plate 2.

The assembling of the buckle will be described. The return spring 3 is disposed between the notches 2*c* of the opposite push plates 2 as shown in FIG. 2, and the unit of the push plates is inserted into the housing 4 from one of the openings 4*a*. Thereafter, a pair of pins 4*c* are inserted into holes 4*d* formed in the housing 4 with force and engaged with elongated holes 2*d* formed in the push plates 2. The push plate 2 is located in the housing 4 by the pin 4*c* at a position where the manipulating lug 2*b* is projected from the opening 4*a*. Consequently, the push plates 2 are prevented from removing from the housing 4. In this state, the engaging projections 2*a* are exposed in the notches 4*b* of the housing 4.

The assembled housing 4 is disposed inside the cover 1 and the manipulating lugs 2*b* of the push plates 2 are projected from the openings 1*a* of the side plates 11 so that the housing 4 is secured to the cover 1. Both ends of the spring-loaded pin 12 engaged with the rounded portions 5*a* of the middle plate 5 and the tongue 6 are inserted into pin holes 1*b* formed in the side plates 11 of the cover 1. Thus, the middle plate 5 is rotatably connected to the cover 1. The rounded portion 7*c* of the bottom plate 7 is connected to the rounded portions 5*b* of the middle plate 5 with the pin 13 so that the middle plate 5 is rotatably connected to the bottom plate 7. The first and second bands 8 and 9 are connected to a watch case (not shown) at respective connecting portions 8*a* and 9*a*. The second band 9 is connected to the connecting lugs 7*a* by a spring-loaded pin 14 or a pin. Thus, the assembling is completed.

The first band 8 is secured to the cover 1 by a wearer. Namely, the end of the first band 8 is inserted into the space between the cover 1 and the housing 4 from the left of the cover (FIG. 3). The tongue 6 is pushed by the band 8 to be rotated in the clockwise direction in FIG. 3 so that the band passes over the tongue 6. The tongue 6 is engaged with the desired adjusting hole 8*b* corresponding to the size of the wrist. Thus, the first band 8 is connected to the cover 1.

The use of the buckle will be described hereinafter. Assuming that the lock of the buckle is released, the middle plate 5 connected to the cover 1 is rotated about the pin 13 to open from the bottom plate 7. The cover 1 is rotated about the spring-loaded pin 12 to open from the middle plate 5 so that the buckle are stretched and expanded. The first and second bands 8 and 9 are applied to the wrist of the wearer.

The cover 1 is put on the middle plate 5 and pressed against the bottom plate 7 together with the middle plate 5. The engaging lugs 7*b* of the bottom plate 7 are inserted into the notches 5*c* of the middle plate 5 and inserted into the notches 4*b* of the housing 4. The slants 2*e* of the engaging projections 2*a* of the respective push plates 2 are abutted on the engaging lugs 7*b*, so that the push plates 2 are inwardly pushed against the elastic force of the spring 3. When each engaging projection 2*a* passes the upper edge of each engaging lug 7*b*, the engaging projection 2*a* is returned by the spring 3 and engaged with the engaging hole 7*d* of the engaging lug 7*b*. Thus, the cover 1 is locked to the bottom plate 7.

In order to unlock the buckle, the manipulating lugs 2*b* of the push plates 2 are pushed at the same time so that the engaging projections 2*a* are disengaged from the engaging lugs 7*b*. Thus, the cover 1 is released from the bottom plate 7.

FIGS. 4 to 7 show a buckle of the second embodiment. The parts which are the same as the first embodiment are identified with the same reference numerals as FIGS. 1 to 3.

Figure 6:
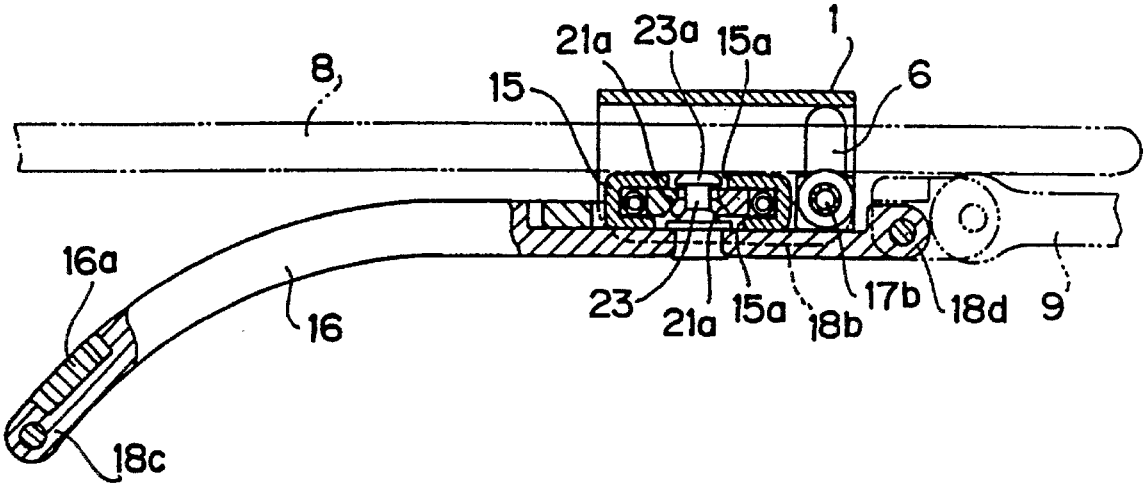
FIG. 6 is a sectional side view of the buckle taken along a line VI—VI of FIG. 5.
Figure 7:
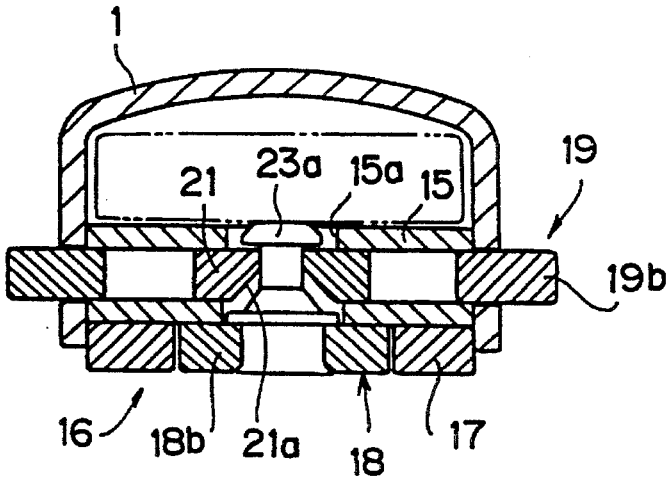
FIG. 7 is a sectional view of the buckle taken along a line VII—VII of FIG. 5.

In the second embodiment, a hollow guide housing 15 has engaging holes 15*a* formed in upper and lower plates thereof corresponding to each other and penetrating through the center of each plate. A pair of push plates 19 slidably mounted in the space of the housing 15 are the same in configuration and disposed in point symmetry with respect to the center of the housing 15. Each push plate 19 comprises an engaging hook 21 having a downward slant 21*a* formed underside thereof (FIGS. 6 and 7). The engaging hooks 21 are disposed opposite to each other and provided corresponding to the engaging holes 15*a* of the housing 15. Between the push plates 19, a pair of return springs 22 are provided on both sides with respect to the longitudinal direction and disposed in point symmetry so as to outwardly urge the push plates 19. The push plate 19 has a width wider than a manipulating lug 19*b*. When the push plates 19 are outwardly urged by the return springs 22 and the manipulating lugs 19*b* are projected from the openings 1*a* of the cover 1, both shoulder portions of the push plates 19 are abutted on inner peripheries of the cover 1, thereby preventing the push plates 19 from removing from the cover 1.

As an alternative manner for preventing the push plate from removing from the housing 15, a periphery of an opening of the housing is inwardly bent to be engaged with the shoulder portions of the push plate.

In the embodiment, a middle plate 16 and a bottom plate 18 are made of metal plate by machining. The middle plate 16 is formed to be curved so as to fit the wrist of the wearer. The middle plate 16 comprises a rectangular frame 16*a* having a large thickness, a pair of connecting lugs 16*b* projected from an end of the frame 16*a*, a pair of arm portions 17 projected from the other end of the frame 16*a* opposite to the connecting lugs 16*b* and having a small thickness, and a pair of connecting lugs 17*a* formed at ends of the arm portions 17. A spring-loaded pin 17*b* or a pin is engaged with the connecting lugs 17*a*, and the tongue 6 is rotatably mounted on the pin 17*b* between the connecting lugs. Both ends of the pin 17*b* are inserted into the pin holes 1*b* of the cover 1 so that the cover 1 is rotatably connected to the middle plate 16. The bottom of the housing 15 is mounted on the arm portions 17 of the middle plate 16 (FIG. 7).

The bottom plate 18 has a width so as to be engaged with the inside of the middle plate 16. The bottom plate comprises a thick plate portion 18*a* engaged in the frame 16*a* of the middle plate, a thin plate portion 18*b* engaged with the arm portions 17, and an engaging lug 23 securely mounted on the thin plate portion 18*b* at the center thereof. The engaging lug 23 has a conical head 23*a* corresponding to the engaging holes 15*a* of the housing 15. The bottom plate 18 has rounded connecting portions 18*c* and 18*d* provided at both ends thereof. The connecting portion 18*c* is rotatably connected to the connecting lugs 16*b* of the middle plate 16 with a pin 16*c* or a spring-loaded pin. The connecting portion 18*d* is rotatably connected to a connecting link 24 with a pin 24*a* or a spring-loaded pin to which an end of the second band 9 is connected.

In the case that it is undesirable to provide the engaging hole 15*a* in the upper plate of the housing 15, a recess is formed on an upper portion of the engaging hook 21 so as to receive the conical head 23*a*.

Describing the use of the buckle, the cover 1 is mounted on the arm portions 17 of the middle plate 16, and the cover 1 is pressed against the bottom plate 18 so that the frame 16*a* engages with the thick plate portion 18*a* and the arm portions 17 engage with the thin plate portion 18*b*. The engaging lug 23 of the bottom plate 18 is inserted into the hole 15*a* of the lower plate of the housing 15. The conical head 23*a* of the engaging lug 23 engages with the downward slants 21*a* of the engaging hooks 21 of the respective push plates 19 to outwardly push the engaging hooks against the elastic forces of the springs 22. When the conical head 23*a* passes the engaging hooks 21, the engaging hooks are returned by the springs 22 and engaged with a stem of the engaging lug 23. Thus, the cover 1 is locked to the bottom plate 18.

In order to disengage the buckle, the push plates 19 are pushed at the same time so that the engaging hooks 21 are opened to disengage the engaging lug 23.

Figure 8:
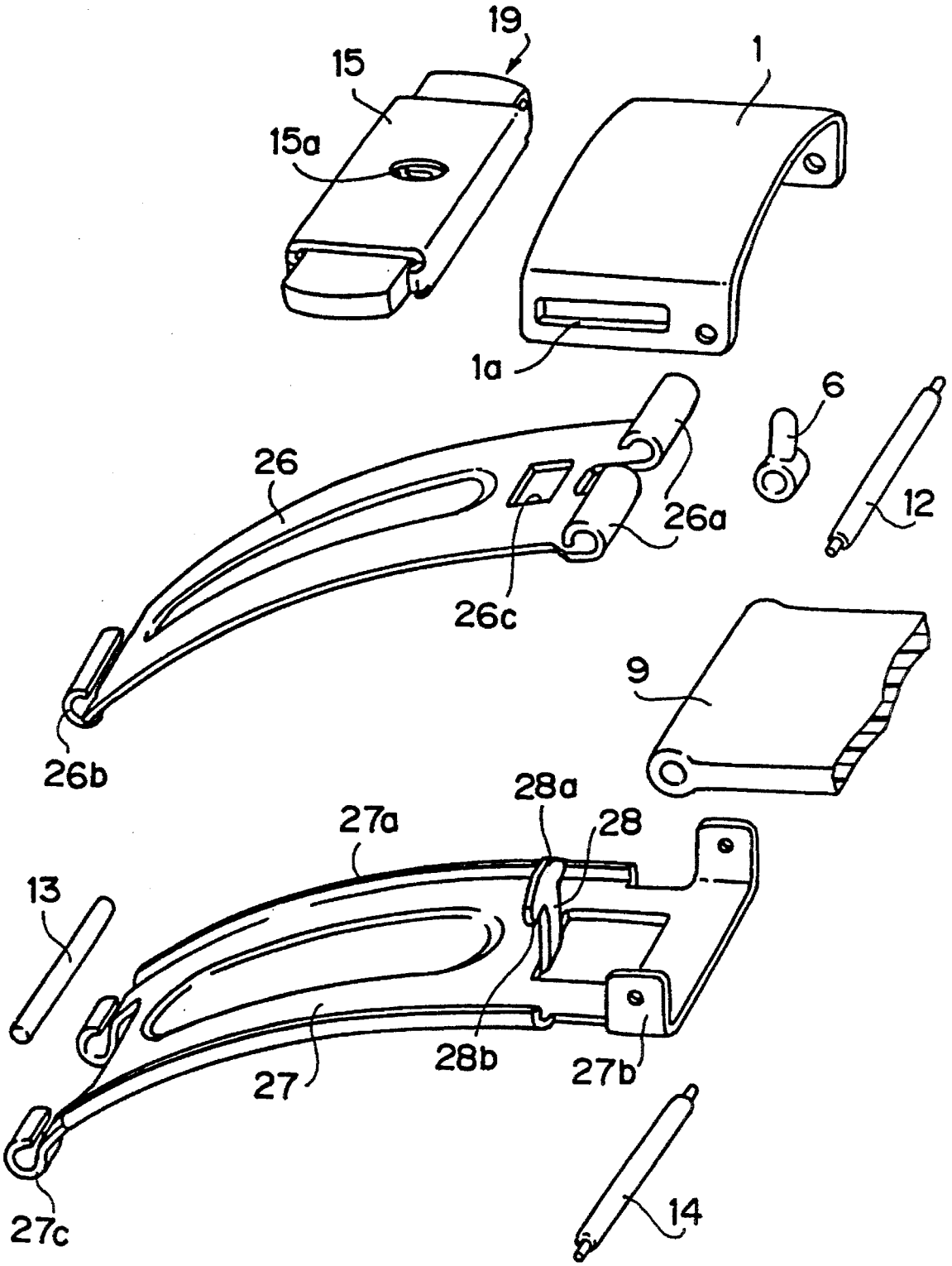
FIG. 8 is an exploded perspective view showing a buckle of a third embodiment.
Figure 9:
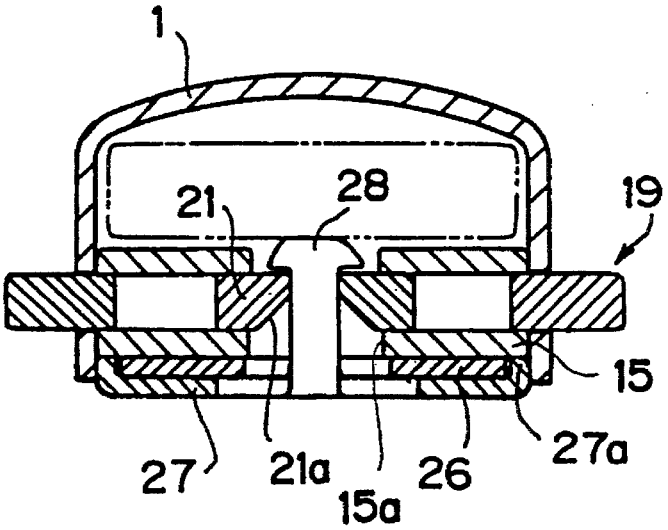
FIG. 9 is a sectional view of the buckle of FIG. 8.
Figure 10:
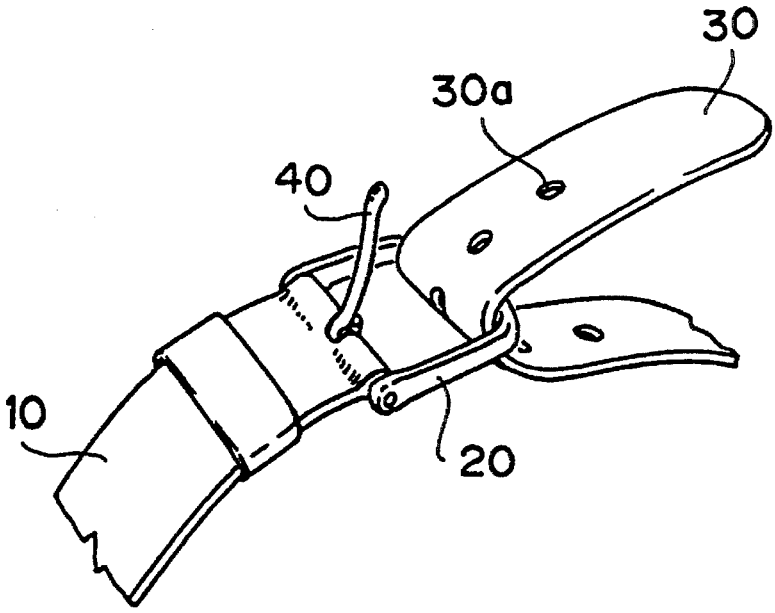
FIG. 10 is a perspective view showing a conventional buckle.
Figure 11:
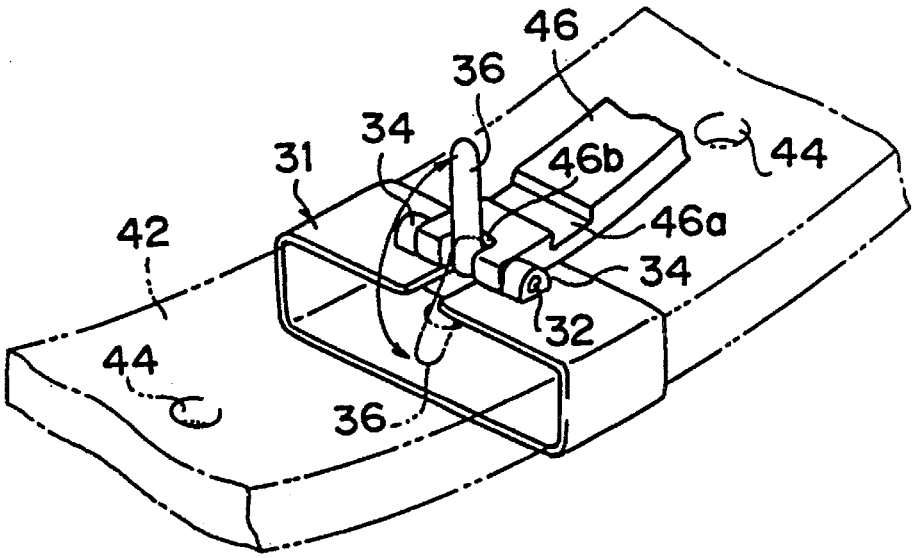
FIG. 11 is a perspective view showing a main part of another conventional buckle.
Figure 12:
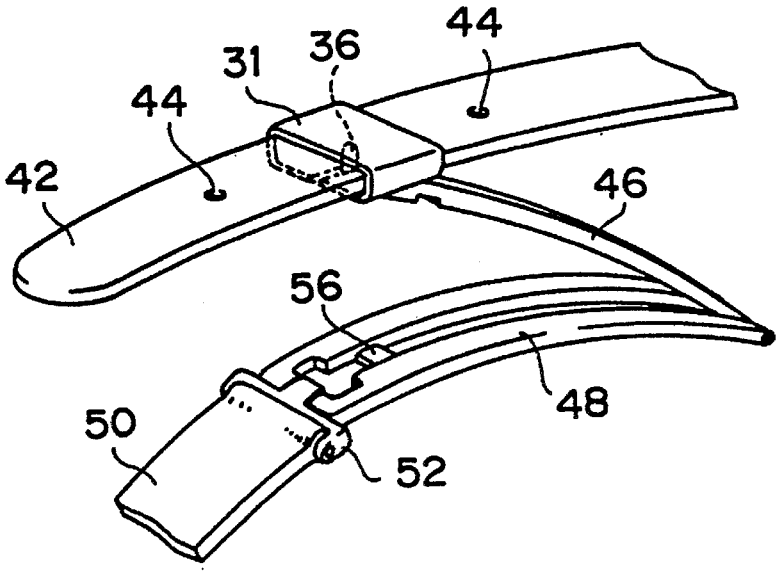
FIG. 12 is a perspective view of the conventional buckle.

FIGS. 8 and 9 show a buckle of the third embodiment. The third embodiment has a feature that a middle plate 26 and a bottom plate 27 are made by the press working. In the cover 1, the housing 15 having a pair of push plates 19 and return springs (not shown) which are the same as the second embodiment are disposed.

The middle plate 26 has a pair of rounded portions 26*a* and a rounded portion 26*b* which are provided at both ends thereof, and a rectangular opening 26*c* formed corresponding to the engaging holes 15*a* of the housing 15. The tongue 6 and the rounded portions 26*a* are rotatably connected to the cover 1 with the spring-loaded pin 12. The bottom plate 27 comprises opposite side flanges 27*a*, a pair of connecting lugs 27*b* provided at one of the ends, each having a hole, and a pair of rounded portions 27*c* provided at the other end. The bottom plate 27 further has an engaging projection 28 having a T-shape formed by cutting and bending the plate. The engaging projection 28 has guide slants 28*a* formed on a top portion thereof opposite to each other, and hooks 28*b* formed on the lower portions of the guide slants 28*b*. The rounded portion 26*b* of the middle plate 26 is rotatably connected to the rounded portions 27*c* of the bottom plate 27 with the pin 13. The second band 9 is connected to the connecting lugs 27*b* with the spring-loaded pin 14.

The use of the buckle will be described. The cover 1 put on the middle plate 26 is pressed against the bottom plate 27 so that the middle plate 26 engages with the side flanges 27*a* of the bottom plate 27. As shown in FIG. 9, the top of the engaging projection 28 of the bottom plate 27 passes the hole 15*a* of the lower plate of the housing 15 and is inserted between the engaging hooks 21 of the push plates 19. The push plates 19 are inwardly pushed by the guide slants 28*a* of the engaging projection 28 against the elastic force of the springs. When the slants 28*a* pass the engaging hooks 21, the engaging hooks 21 are returned by the springs and engaged with hooks 28*b* of the engaging projection 28. Thus, the cover 1 is locked to the bottom plate 27.

PROBABILITY OF INDUSTRIAL EXPLOITATION

In accordance with the present invention, if the length of the band is adjusted once, it is not necessary to adjust the length when the watch is put on the wrist. Consequently, the surface of the band is not hurt. Since the first band is connected to the second band through the buckle, there is no danger of dropping the watch when putting on and taking off it. By pushing the push plates at the same time, the buckle is easily disengaged.

We claim:

1. A buckle for watch bands having a first band member having a plurality of adjusting holes and a second band member, the buckle including a cover having opposite side plates, each of which has an opening, a middle plate rotatably connected to an end of said cover at a longitudinal first end thereof, and a bottom plate rotatably connected to a second end of said middle plate at one of longitudinal ends thereof, the buckle comprising a guide housing disposed in an inside of said cover;

a space formed between an upper plate of the guide housing and an inside wall of the cover in which the first band member is inserted and supported;

a pair of push plates slidably mounted in said guide housing so as to be slid in the lateral direction with respect to the longitudinal direction of the bands;

a spring provided between the push plates for outwardly urging the push plates respectively;

stopping means for stopping each of the push plates at a position where an outer end portion of the push plate is projected from the opening of the side plate of the cover so as to be operated by a finger of a wearer;

each push plate having an engaging projection and a slant formed on the underside of the engaging projection;

a tongue rotatably mounted on the first end of the middle plate to be engaged with the adjusting hole of the first band member; and at least one engaging lug formed on said bottom plate to be projected to the push plates;

the engaging lug being arranged such that a part of the lug is engaged with said slant of the push plate so as to inwardly move the push plate due to the inclination of the slant when the bottom plate is pivoted toward the cover, and that the engaging lug engages with the engaging projection when passing the slant.

2. The buckle according to claim 1, wherein said stopping means comprises pins securely mounted on the guide housing and holes formed in the push plates so as to be engaged with the pins.

3. The buckle according to claim 1, wherein each of said engaging projection of the push plates is an engaging hook provided opposite to engaging hook of the other push plate.

4. The buckle according to claim 1, wherein said push plates are disposed in point symmetry with respect to a center of the housing.

5. The buckle according to claim 1, wherein said engaging lug of the bottom plate has a conical head at a top thereof.

* * * * *